US009425530B2

(12) United States Patent
Wada

(10) Patent No.: US 9,425,530 B2
(45) Date of Patent: Aug. 23, 2016

(54) CONTACT HAVING A SPRING PORTION JOINED TO A SECOND SPRING PORTION HAVING A CONVEX SHAPED BENT FULCRUM PORTION

(71) Applicant: JAPAN AVIATION ELECTRONICS INDUSTRY, LIMITED, Tokyo (JP)

(72) Inventor: Takamitsu Wada, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/814,825

(22) Filed: Jul. 31, 2015

(65) Prior Publication Data

US 2016/0126650 A1 May 5, 2016

(30) Foreign Application Priority Data

Oct. 31, 2014 (JP) ..... 2014-223237

(51) Int. Cl.

| | |
|---|---|
| ***H01R 4/52*** | (2006.01) |
| ***H01R 13/02*** | (2006.01) |
| ***H01R 4/02*** | (2006.01) |
| ***H01R 4/48*** | (2006.01) |

(52) U.S. Cl.

CPC ..... *H01R 13/02* (2013.01); *H01R 4/02* (2013.01); *H01R 4/489* (2013.01)

(58) Field of Classification Search

CPC ..... H01R 4/4809; H01R 4/489; H01R 13/05; H01R 13/17; H01R 13/187; H01R 1/06722

USPC ..... 439/816, 818, 819

See application file for complete search history.

(56) References Cited

U.S. PATENT DOCUMENTS

| | | | | |
|---|---|---|---|---|
| 5,012,078 | A * | 4/1991 | Pernet | G06K 7/0021 235/441 |
| 5,080,602 | A * | 1/1992 | Lee Chao | H01R 12/83 439/326 |
| 5,100,337 | A * | 3/1992 | Lee Chao | H01R 12/83 439/326 |
| 6,175,076 | B1 * | 1/2001 | Rieuvernet | H05K 9/0016 174/17 CT |
| 8,727,819 | B2 * | 5/2014 | Giefers | H01R 4/489 439/441 |
| 2009/0253306 | A1 * | 10/2009 | Knoerrchen | H01R 4/4836 439/651 |
| 2011/0318975 | A1 * | 12/2011 | Giefers | H01R 4/489 439/818 |
| 2012/0108113 | A1 * | 5/2012 | Yamaguchi | H01R 13/187 439/842 |
| 2014/0045389 | A1 | 2/2014 | Yoshikawa et al. | |
| 2015/0093925 | A1 * | 4/2015 | Bruchmann | H01R 13/62933 439/153 |

FOREIGN PATENT DOCUMENTS

| | | |
|---|---|---|
| JP | 2014-035835 A | 2/2014 |
| JP | 2014-075332 A | 4/2014 |

* cited by examiner

*Primary Examiner* — Chandrika Prasad

(74) *Attorney, Agent, or Firm* — Collard & Roe, P.C.

(57) ABSTRACT

A contact includes a to-be-fixed portion to be fixed to a connector board; a first spring portion including a first rear end portion joined to the to-be-fixed portion, the first spring portion extending forward from the to-be-fixed portion and elastically deformable; a joining portion joined to a first front end portion of the first spring portion; a second spring portion including a second front end portion joined to the joining portion, the second spring portion disposed adjacent to the first spring portion in a width direction, extending rearward from the joining portion, and elastically deformable; a contact portion provided to the second spring portion and adapted to be in contact with a terminal; and a fulcrum bend portion that is convex downward provided between its second front end portion and its second rear end portion, and is adapted to be constantly in contact with the connector board.

11 Claims, 6 Drawing Sheets

CONTACT HAVING A SPRING PORTION JOINED TO A SECOND SPRING PORTION HAVING A CONVEX SHAPED BENT FULCRUM PORTION

This application is based upon and claims the benefit of priority from Japanese Patent Application No. 2014-223237, filed on Oct. 31, 2014, the disclosure of which is incorporated herein in its entirety by reference.

BACKGROUND OF THE INVENTION:

This invention relates to a contact and a connector comprising the contact.

As an elastic contact for use in a ground/signal/antenna connection connector or a card connector for a digital device such as a smartphone, there is known a structure as described in JP-A-2014-35835 (Patent Document 1) in which, in order to achieve miniaturization of a contact while maximizing its spring length, two types of plate springs are placed side by side and joined together and an end portion of only one of the plate springs is fixed to a board of a digital device.

In such a structure, however, in order to design the properties as a spring such as a contact force and a displacement amount when a connection object is in contact with the contact, the balance of forces of the two types of plate springs should be strictly designed as described in, for example, JP-A-2014-75332 (Patent Document 2).

This point will be described with reference to FIG. 12. As shown in FIG. 12, a contact 30 of Patent Document 2 comprises a fixing portion 31 fixed to a connector body 10, a first spring portion 33 provided in a rectangular annular shape and elastically deformable relative to the fixing portion 31, a second spring portion 34 projectingly provided on the inner peripheral side of the first spring portion 33 and elastically deformable relative to the first spring portion 33, and a contact portion 35 provided at a free end of the second spring portion 34.

With this structure, when a connection object such as a card is pressed against the contact portion 35, the contact portion 35 is pushed down toward the board 3 side, while an opposite side portion 33A or a joining portion 37 rises, so that the first spring portion 33 and the second spring portion 34 are elastically deformed.

Herein, in order to balance the forces of the first spring portion 33 and the second spring portion 34 as the two types of plate springs, the contact 30 is designed so that the spring stiffness of the first spring portion 33 and the spring stiffness of the second spring portion 34 are equal to each other. Specifically, a value twice the width of each of lateral side portions 33B of the first spring portion 33 and a value of the width of the second spring portion 34 are approximate to each other.

SUMMARY OF THE INVENTION:

However, as described above, in the structure of Patent Document 2, the size of each of the first spring portion 33 and the second spring portion 34 is regulated by the size of the other. Therefore, there is a problem that it is difficult to design the first spring portion 33 and the second spring portion 34 independently of each other, resulting in that the degree of freedom of design is low.

This invention has been made in order to solve the above-mentioned problem and has an object to provide a contact that enables its properties as a spring to be designed more easily than before.

In order to achieve the above-mentioned object, a first aspect of this invention is a contact electrically connecting a plurality of connection objects, comprising: a to-be-fixed portion adapted to be fixed to a fixing member; a first spring portion comprising a rearward end portion, in a front-rear direction, joined to the to-be-fixed portion, the first spring portion extending forward from the to-be-fixed portion and elastically deformable relative to the to-be-fixed portion; a joining portion joined to a forward end portion of the first spring portion; a second spring portion comprising a forward end portion joined to the joining portion, the second spring portion disposed adjacent to the first spring portion in a width direction perpendicular to the front-rear direction, extending rearward from the joining portion, and elastically deformable relative to the joining portion; and a contact portion provided to the second spring portion and adapted to be in contact with a terminal of one of the connection objects, wherein the second spring portion comprises, between the forward end portion thereof and a rearward end portion thereof, a fulcrum bend portion that is convex in a downward direction perpendicular to the front-rear direction and to the width direction and that is adapted to be constantly in contact with the fixing member, and wherein the fulcrum bend portion is disposed between the forward end portion of the first spring portion and the contact portion in the front-rear direction, and the contact portion is disposed between the fulcrum bend portion and the rearward end portion of the first spring portion in the front-rear direction.

In the contact, two to-be-fixed portions and two first spring portions may be provided in the width direction, and the second spring portion may be disposed between the two first spring portions in the width direction.

The first spring portion may be provided with a first bend portion, the first spring portion may be provided with a second bend portion between the first bend portion and the rearward end portion, and the first spring portion may comprise, between the first bend portion and the second bend portion, a portion which is convex in an upward direction perpendicular to the front-rear direction and to the width direction.

In this structure, the first spring portion may comprise a third bend portion provided between the contact portion and the second bend portion in the front-rear direction.

Further, if two to-be-fixed portions and two first spring portions are provided, the two to-be-fixed portions may be joined together.

Still further, in a structure which comprises the third bend portion, the first spring portion may comprise a fourth bend portion provided between the first bend portion and the third bend portion.

On the other hand, the contact is formed from a single plate-shape member for example.

The fixing member is the other of the connection objects for example, and, the to-be-fixed portion is adapted to be fixed to the other of the connection objects by soldering. In this case, the other of the connection objects is a board for example.

Further, the fixing member may be a connector body which forms a connector adapted to be attached to the other of the connection objects.

A second aspect of this invention is a connector comprising a connector body and the contact according to the first aspect fixed to the connector body

EFFECT OF THE INVENTION

According to this invention, it is possible to provide a contact that enables its properties as a spring to be designed more easily than before.

MODE FOR CARRYING OUT THE INVENTION:

Hereinbelow, preferred embodiments of this invention will be described in detail with reference to the drawings.

First, referring to FIGS. 1 and 2, the structure of a contact 1 according to a first embodiment of this invention will be described.

Figure 1:
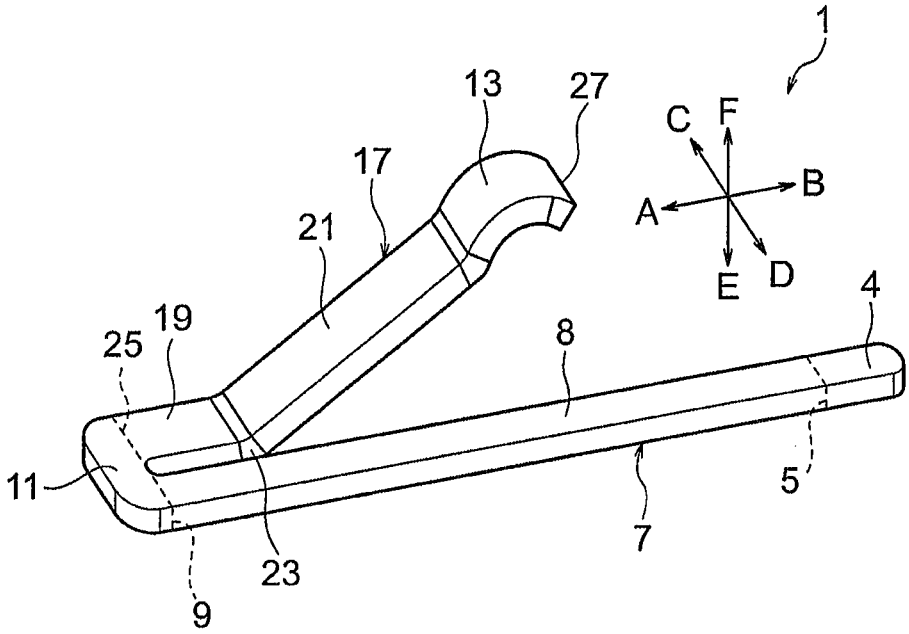
FIG. 1 is a perspective view showing a contact 1 according to a first embodiment of this invention.

In the following description, it is assumed that a direction A in FIG. 1 is forward and that a direction B in FIG. 1 is rearward.

Figure 2:
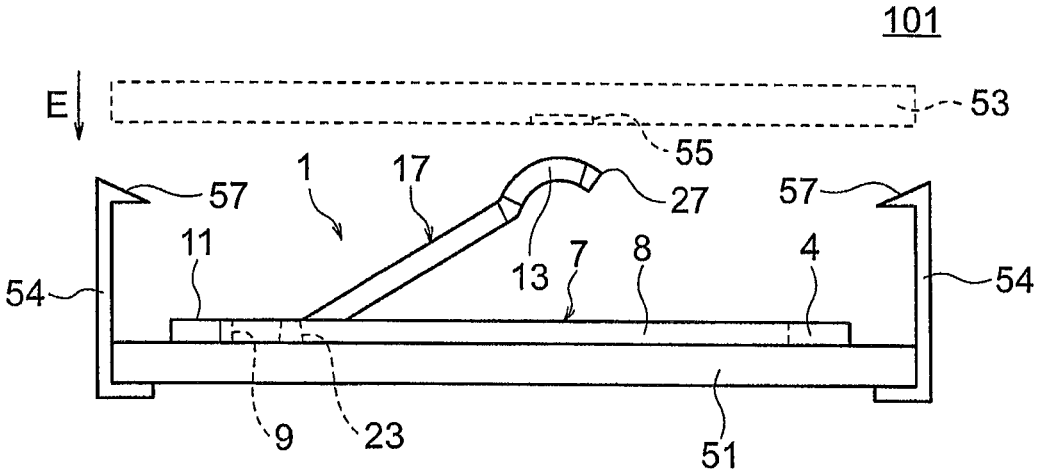
FIG. 2 is a side view showing a connector 101 comprising the contact 1.

As shown in FIGS. 1 and 2, the contact 1 comprises a to-be-fixed portion 4 adapted to be fixed to a connector board 51 (FIG. 2) as a fixing member, a first spring portion 7 joined to the to-be-fixed portion 4 and extending forward (direction A) from the to-be-fixed portion 4 so as to be elastically deformable relative to the to-be-fixed portion 4 or relative to the connector board 51 when the to-be-fixed portion 4 is fixed thereto, and a joining portion 11 joined to the first spring portion 7.

The contact 1 further comprises a second spring portion 17 joined to the joining portion 11, disposed adjacent to the first spring portion 7, and extending rearward (direction B) from the joining portion 11 so as to be elastically deformable relative to the joining portion 11, and a contact portion 13 provided to the second spring portion 17 and adapted to be in contact with a terminal 55 of a mating board 53 (FIG. 2) as one of connection objects.

Next, the respective members forming the contact 1 will be described in further detail with reference to FIGS. 1 and 2.

The to-be-fixed portion 4 is a terminal adapted to be fixed to the connector board 51 by soldering or the like.

The first spring portion 7 is a plate spring extending in the direction A from the to-be-fixed portion 4 and comprises a plate-shape first spring body 8, a first front end portion 9 as a forward end portion of the first spring body 8, and a first rear end portion 5 as a rearward end portion of the first spring body 8. The first rear end portion 5 is joined to the to-be-fixed portion 4 and the first front end portion 9 is joined to the joining portion 11.

The joining portion 11 is a plate-shape member joining the first spring portion 7 and the second spring portion 17 together.

The second spring portion 17 is disposed adjacent to the first spring portion 7 in the width direction (direction C) perpendicular to the front-rear direction and comprises a plate-shape base portion 19 joined to the joining portion 11 and extending in the direction B from the joining portion 11, a plate-shape inclined portion 21 inclined upward in FIG. 1 (in a direction perpendicular to the directions A and B and to the directions C and D, i.e. in a direction F) with respect to the base portion 19, the curved plate-shape contact portion 13 provided to the inclined portion 21, and a fulcrum bend portion 23 joining the base portion 19 and the inclined portion 21 together.

The second spring portion 17 comprises a second front end portion 25 as its forward end portion and a second rear end portion 27 as its rearward end portion. The second front end portion 25 is provided to the base portion 19 and joined to the joining portion 11 and the second rear end portion 27 is joined to the contact portion 13. The fulcrum bend portion 23 is provided between the second front end portion 25 and the second rear end portion 27. That is, the fulcrum bend portion 23 is provided rearward of the joining portion 11 in the front-rear direction.

The fulcrum bend portion 23 is convex downward in FIG. 1 (in a direction perpendicular to the directions A and B and to the directions C and D, i.e. in a direction E) and is constantly in contact with the connector board 51 when the contact 1 is mounted on the connector board 51 (see FIG. 2).

The contact portion 13 is disposed between the fulcrum bend portion 23 and the first rear end portion 5 of the first spring portion 7 in the front-rear direction.

The contact 1 is formed from a single plate-shape member such as a conductive metal plate.

The above is a description of the structure of the contact 1.

Next, the structure of a connector 101 comprising the contact 1 will be described with reference to FIG. 2.

As shown in FIG. 2, the connector 101 includes the connector board 51 as the other connection object, the contact 1 mounted on the connector board 51 such that the to-be-fixed portion 4 is fixed to the connector board 51, and clips 54 in the form of elastic springs provided to the connector board 51. Each clip 54 comprises a tapered portion 57 with its upper surface inclined toward the contact 1 side.

Although details will be described later, the connector 101 fixes the mating board 53 by sandwiching the mating board 53 between the clips 54 and the contact 1.

The above is a description of the structure of the connector 101.

Next, the sequence of attaching the mating board 53 to the connector 101 will be described with reference to FIGS. 2 to 4.

First, in the state shown in FIG. 2, the mating board 53 is disposed above the connector 101 so that the terminal 55 of the mating board 53 faces the contact portion 13 of the contact 1.

Figure 3:
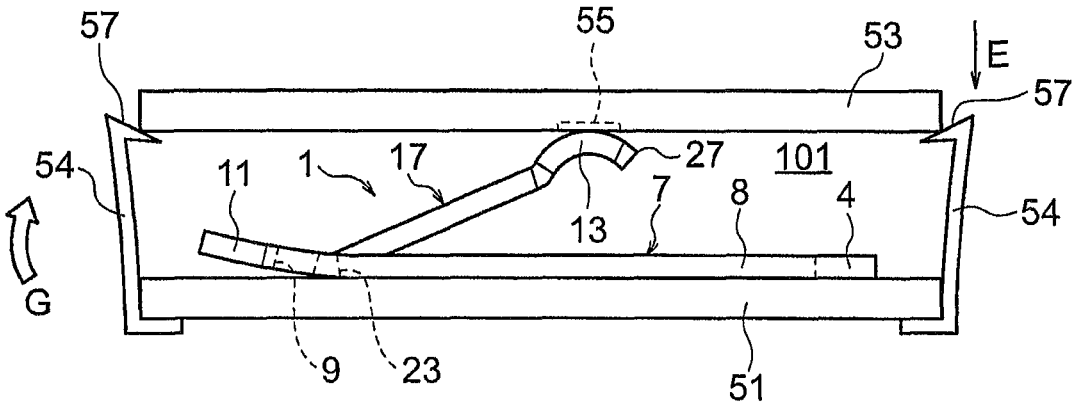
FIG. 3 is a side view for explaining the sequence of attaching a mating board 53 as a connection object to the connector 101 comprising the contact 1.

Then, from this state, as shown in FIG. 3, the mating board 53 is moved downward (direction E) to abut against the tapered portions 57 of the clips 54 and is further pushed in the direction E to force open the clips 54.

In this state, the mating board 53 also abuts against the contact portion 13 of the second spring portion 17 to push the contact portion 13 in the direction E.

Then, the second spring portion 17 is rotated in a direction G in FIG. 3 centering around the fulcrum bend portion 23.

Since the joining portion 11 is joined to the second spring portion 17, the joining portion 11 is rotated in the direction G in FIG. 3 and thus raised from the connector board 51.

Further, since the first spring portion 7 is joined to the second spring portion 17 via the joining portion 11, the first front end portion 9 of the first spring portion 7 is also raised from the connector board 51.

Figure 4:
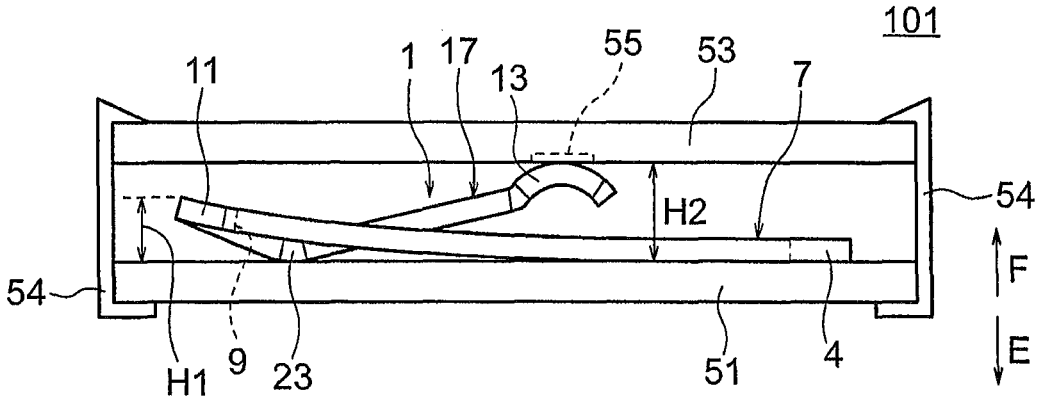
FIG. 4 is a side view showing a state where the mating board 53 as the connection object is attached to the connector 101 comprising the contact 1.

When the mating board 53 pushes open the clips 54 until the mating board 53 is separated from the tapered portions 57, the clips 54 are each returned to its initial shape by elasticity so that, as shown in FIG. 4, the clips 54 are in abutment with the mating board 53 to hold therebetween the mating board 53 jointly with the contact portion 13 of the second spring portion 17.

In this state, the terminal 55 of the mating board 53 and the contact portion 13 of the second spring portion 17 are in electrical contact with each other, wherein the mating board 53 is attached to the connector 101.

Herein, the fulcrum bend portion 23 is constantly in contact with the connector board 51 in all cases of FIGS. 2 to 4 and serves as a fulcrum when the contact 1 is deformed so that the second spring portion 17 is rotated in the direction G.

Therefore, it is possible to design the first spring portion 7 and the second spring portion 17 independently of each other.

More specifically, in the state shown in FIG. 4, a force of the contact portion 13 to abut against the terminal 55 (force to push the terminal 55 in the direction F) depends on a force (direction E) of the first spring portion 7 to return to the connector board 51 side and a force (direction F) of the second spring portion 17 to return to the height before the displacement.

On the other hand, since the fulcrum bend portion 23 is constantly in contact with the connector board 51, the force of the first spring portion 7 to return to the connector board 51 side and the force of the second spring portion 17 to return to the height before the displacement can be set individually.

As shown in FIG. 4, in the state where the mating board 53 is attached to the connector 101, the joining portion 11 is in the state of being raised from the connector board 51. In this event, if a distance H1 between the joining portion 11 (herein, an upper surface of the joining portion 11) and the connector board 51 is greater than or equal to a distance H2 between the contact portion 13 (herein, an upper surface of the contact portion 13) and the connector board 51, the joining portion 11 is brought into abutment with the mating board 53 so that there is a possibility of the occurrence of wear of the contact 1 or the mating board 53 or a short circuit, and since the displacement of the first spring portion 7 is regulated, its displacement amount decreases so that there is a possibility that a predetermined contact force is not obtained between the terminal 55 of the mating board 53 and the contact portion 13 of the second spring portion 17. Therefore, the distance H1 is preferably less than the distance H2.

Herein, since the fulcrum bend portion 23 of the contact 1 is constantly in contact with the connector board 51, there is an advantage in that the distance H1 can be easily estimated compared to the case of non-contact therebetween (conventional structure).

Accordingly, also from this point, the spring properties of the contact 1 can be designed more easily than the conventional structure.

As described above, according to the first embodiment, the contact 1 comprises the to-be-fixed portion 4 adapted to be fixed to the connector board 51, the first spring portion 7 joined to the to-be-fixed portion 4 and extending forward from the to-be-fixed portion 4 so as to be elastically deformable relative to the to-be-fixed portion 4 or relative to the connector board 51 when the to-be-fixed portion 4 is fixed thereto, the joining portion 11 joined to the first spring portion 7, the second spring portion 17 joined to the joining portion 11, disposed adjacent to the first spring portion 7, and extending rearward from the joining portion 11 so as to be elastically deformable relative to the joining portion 11, and the contact portion 13 provided to the second spring portion 17 and adapted to be in contact with the terminal 55 of the mating board 53 as one of the connection objects, wherein the fulcrum bend portion 23 adapted to be constantly in contact with the connector board 51 is provided between the second front end portion 25 and the second rear end portion 27 of the second spring portion 17, the fulcrum bend portion 23 is disposed between the first front end portion 9 as the forward end portion of the first spring portion 7 and the contact portion 13 in the front-rear direction, and the contact portion 13 is disposed between the fulcrum bend portion 23 and the first rear end portion 5 as the rearward end portion of the first spring portion 7 in the front-rear direction.

With this structure, it is possible to design the first spring portion 7 and the second spring portion 17 independently of each other.

Next, a second embodiment of this invention will be described with reference to FIG. 5.

The second embodiment is configured such that two to-be-fixed portions 4 and two first spring portions 7 are provided in the first embodiment.

In the second embodiment, the same reference numerals as in the first embodiment are assigned to components that achieve the same functions as in the first embodiment and portions different from those of the first embodiment will be mainly described.

Figure 5:
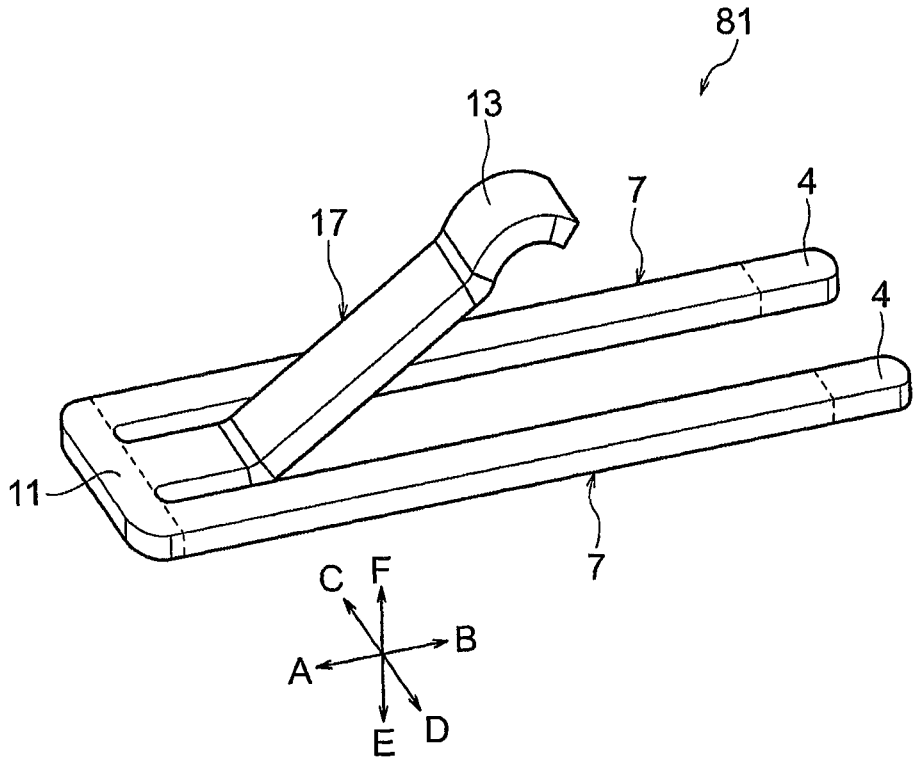
FIG. 5 is a perspective view showing a contact 81 according to a second embodiment of this invention.

As shown in FIG. 5, a contact 81 according to the second embodiment comprises two to-be-fixed portions 4 and two first spring portions 7.

Specifically, the two to-be-fixed portions 4 and the two first spring portions 7 are provided in a direction C in FIG. 5 (i.e. in the width direction).

A second spring portion 17 is disposed between the two first spring portions 7.

With this structure, compared to the case where the single first spring portion 7 is provided, the second spring portion 17 is difficult to deform in the direction C or D.

Therefore, even in the case where the deformation of the second spring portion 17 arises as an issue, it is possible to prevent the second spring portion 17 from bending in the direction C or D.

Accordingly, the contact 81 according to the second embodiment is suitable for a case where importance is attached to the stability.

Next, a third embodiment of this invention will be described with reference to FIGS. 6 to 8.

The third embodiment is configured such that each of the first spring portions 7 is provided with a first bend portion 61 and a second bend portion 63 in the second embodiment.

In the third embodiment, the same reference numerals as in the second embodiment are assigned to components that achieve the same functions as in the second embodiment and portions different from those of the second embodiment will be mainly described.

Figure 6:
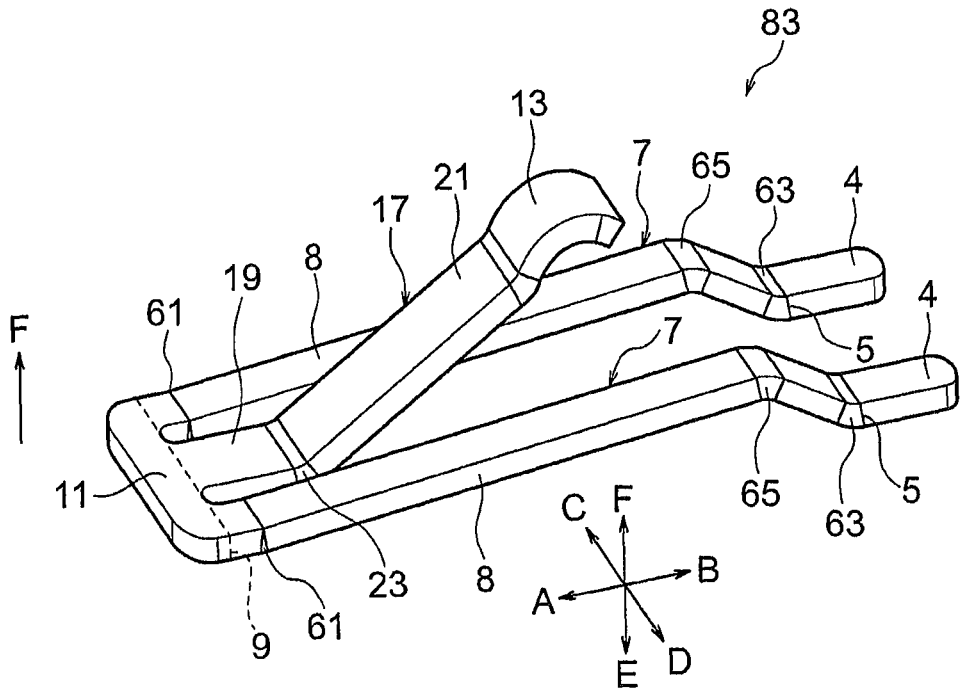
FIG. 6 is a perspective view showing a contact 83 according to a third embodiment of this invention.
Figure 7:
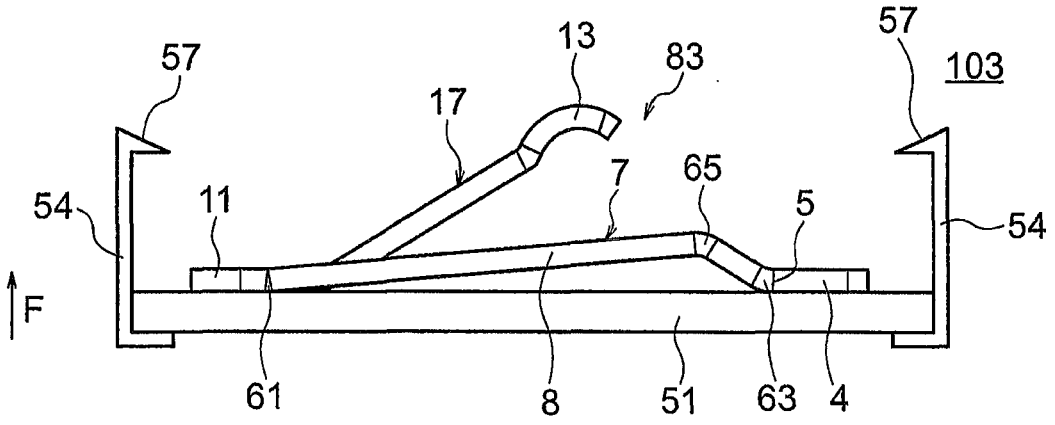
FIG. 7 is a side view showing a connector 103 comprising the contact 83.
Figure 8:
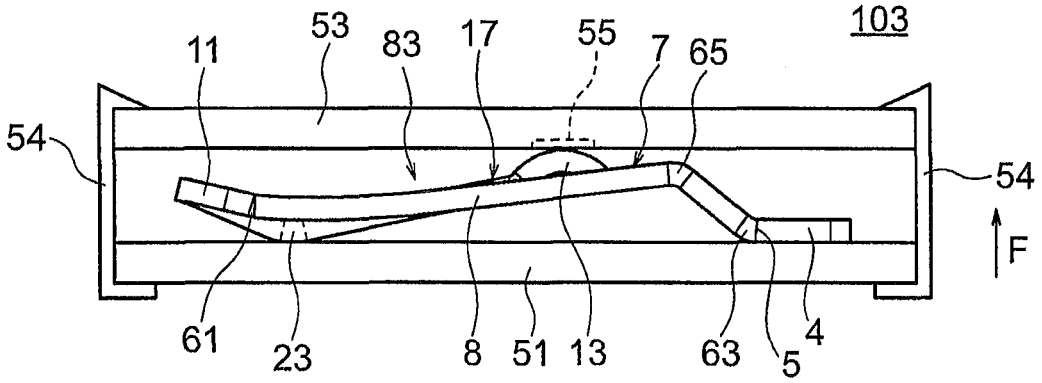
FIG. 8 is a side view showing a state where a mating board 53 as a connection object is attached to the connector 103 comprising the contact 83.

As shown in FIGS. 6 to 8, a contact 83 according to the third embodiment is configured such that a first spring body 8 of each of first spring portions 7 is provided with a first bend portion 61 and a second bend portion 63.

More specifically, the first bend portion 61 is provided between a first front end portion 9 and a fulcrum bend portion 23 in the front-rear direction and the second bend portion 63 is provided between the first bend portion 61 and a first rear end portion 5.

Since the first bend portion 61 and the second bend portion 63 are each bent so as to be convex downward, a third bend portion 65 which is convex upward (convex in a direction F) is provided between the first bend portion 61 and the second bend portion 63. The third bend portion 65 is provided between the first rear end portion 5 and a contact portion 13 in the front-rear direction.

An advantage with this structure will be described with reference to FIGS. 6 and 7.

When handling the contact 83 shown in FIG. 6 alone or when handling a connector board 51 after the contact 83 is mounted on the connector board 51 in the state where clips 54 shown in FIG. 7 are not attached to the connector board 51, if a mounting tool, a hand, or the like abuts against a second spring portion 17, there is a possibility of damage to the second spring portion 17.

In view of this, as shown in FIG. 6, by providing the third bend portions 65, which are convex upward, between the first bend portions 61 and the second bend portions 63 (particularly between the first rear end portions 5 and the contact portion 13), even if the mounting tool, the hand, or the like approaches the contact portion 13 or the second spring portion 17 from the to-be-fixed portion 4 side, the mounting tool, the hand, or the like may abut against the third bend portions 65 before abutting against the contact portion 13 or the second spring portion 17.

Accordingly, the contact 83 according to the third embodiment is configured such that the second spring portion 17 is difficult to damage.

Next, a fourth embodiment of this invention will be described with reference to FIG. 9.

The fourth embodiment is configured such that the two to-be-fixed portions 4 are joined together in the third embodiment.

In the fourth embodiment, the same reference numerals as in the third embodiment are assigned to components that achieve the same functions as in the third embodiment and portions different from those of the third embodiment will be mainly described.

Figure 9:
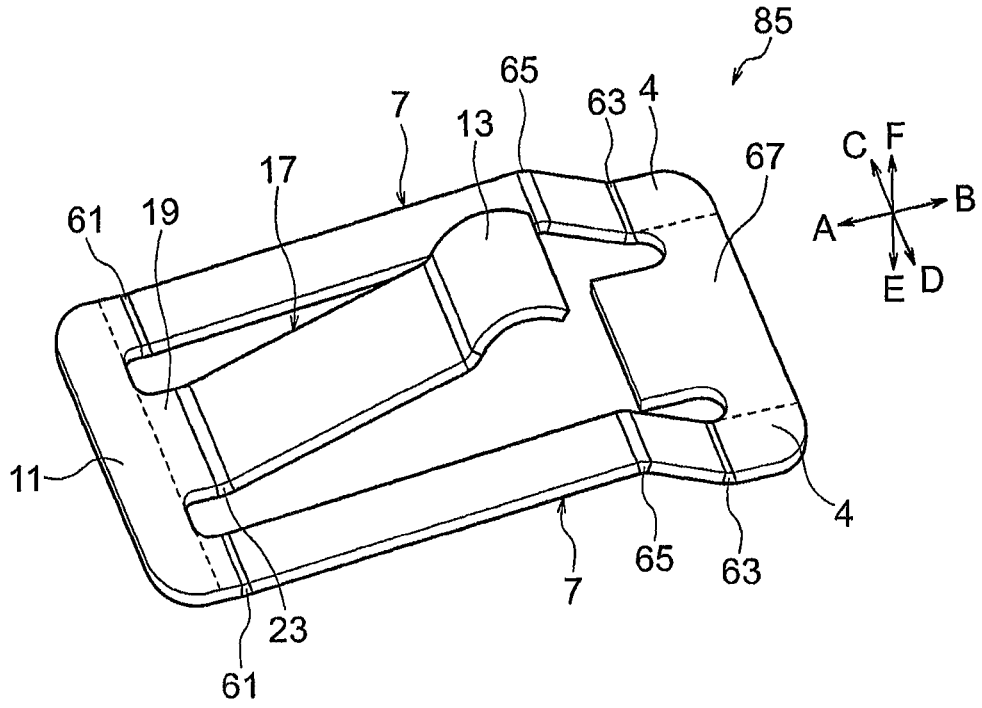
FIG. 9 is a perspective view showing a contact 85 according to a fourth embodiment of this invention.

As shown in FIG. 9, a contact 85 according to the fourth embodiment is configured such that two to-be-fixed portions 4 are joined together and that a joining portion therebetween forms a flat plate-shape to-be-fixed portion joining portion 67.

By joining the two to-be-fixed portions 4 together as described above, the to-be-fixed portions 4, the to-be-fixed portion joining portion 67, a joining portion 11, and first spring portions 7 jointly form an integrated frame.

Therefore, the contact 85 according to the fourth embodiment can be improved in strength.

Further, by providing the flat plate-shape to-be-fixed portion joining portion 67, when mounting the contact 85 on a connector board 51, the to-be-fixed portion joining portion 67 can be used as a portion adapted to be in contact with a mounting tool such as a suction pad and thus it is possible to improve the mounting workability.

Next, a fifth embodiment of this invention will be described with reference to FIG. 10.

The fifth embodiment is configured such that a fourth bend portion 69 is further provided between the first bend portion 61 and the third bend portion 65 in the third embodiment.

In the fifth embodiment, the same reference numerals as in the third embodiment are assigned to components that achieve the same functions as in the third embodiment and portions different from those of the third embodiment will be mainly described.

Figure 10:
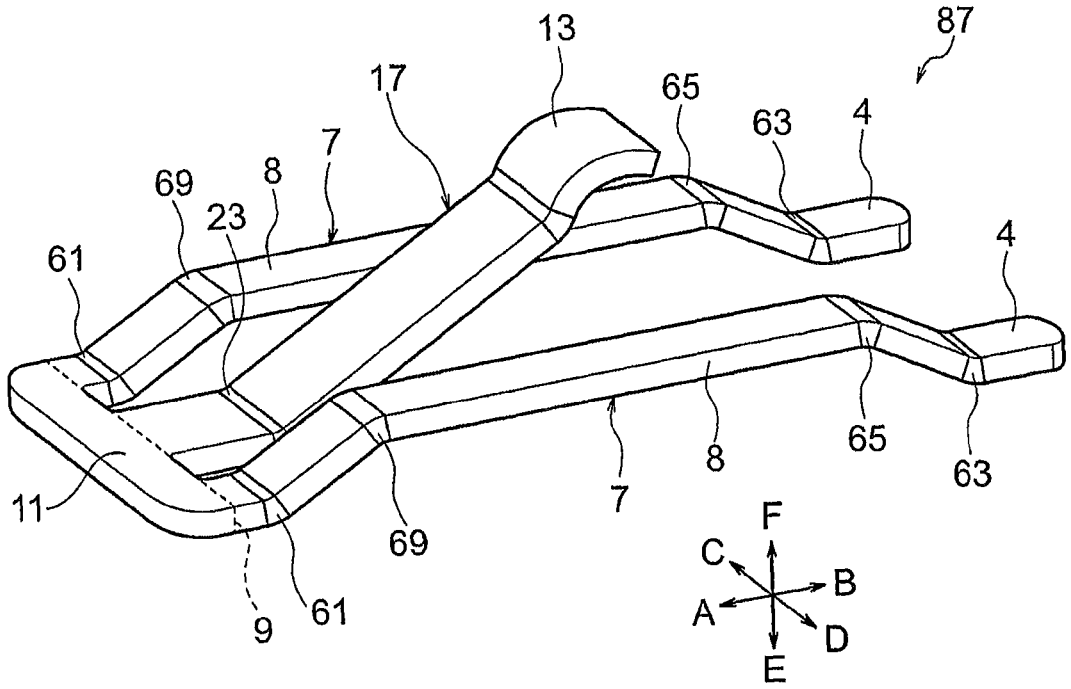
FIG. 10 is a perspective view showing a contact 87 according to a fifth embodiment of this invention.

As shown in FIG. 10, a contact 87 according to the fifth embodiment is configured such that each of first spring portions 7 is further provided with a fourth bend portion 69 between a first bend portion 61 and a third bend portion 65. The fourth bend portion 69 is preferably provided between a first front end portion 9 and a fulcrum bend portion 23 in the front-rear direction.

By providing the fourth bend portions 69 as described above, even if a mounting tool, a hand, or the like approaches a contact portion 13 or a second spring portion 17 from the joining portion 11 side, the mounting tool, the hand, or the like may abut against the fourth bend portions 69 before abutting against the contact portion 13 or the second spring portion 17.

Accordingly, the contact 87 according to the fifth embodiment is configured such that the second spring portion 17 is more difficult to damage.

Next, a sixth embodiment of this invention will be described with reference to FIG. 11.

The sixth embodiment is configured such that the to-be-fixed portion 4 is not fixed to the connector board 51 by soldering, but is fixed to a connector body 56 in the first embodiment.

In the sixth embodiment, the same reference numerals as in the first embodiment are assigned to components that achieve the same functions as in the first embodiment, thereby omitting a description thereof.

Figure 11:
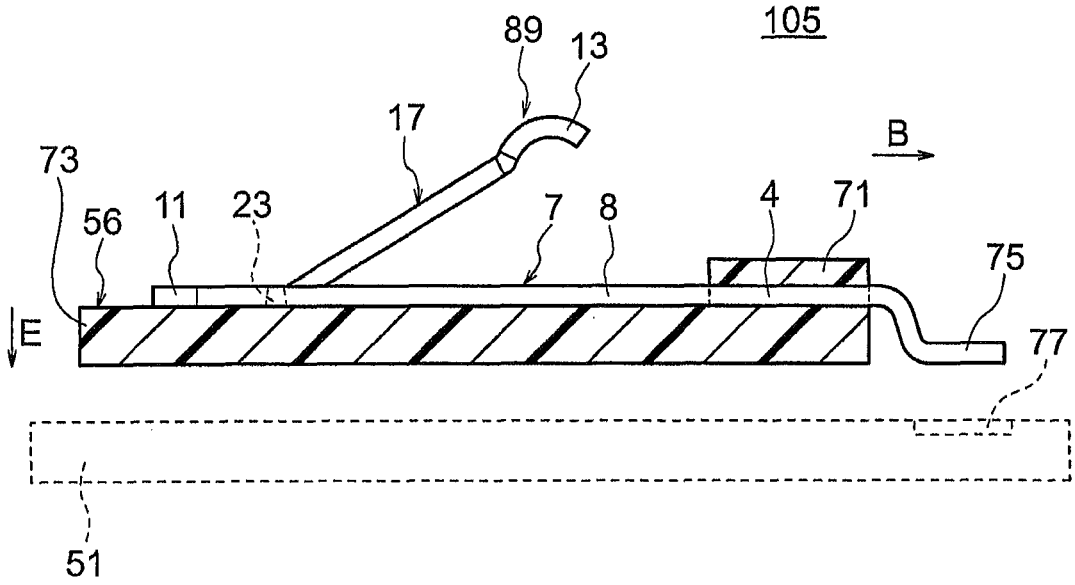
FIG. 11 is a side view showing a connector 105 comprising a contact 89 according to a sixth embodiment of this invention, wherein a connector body 56 is shown in cross section.
Figure 12:
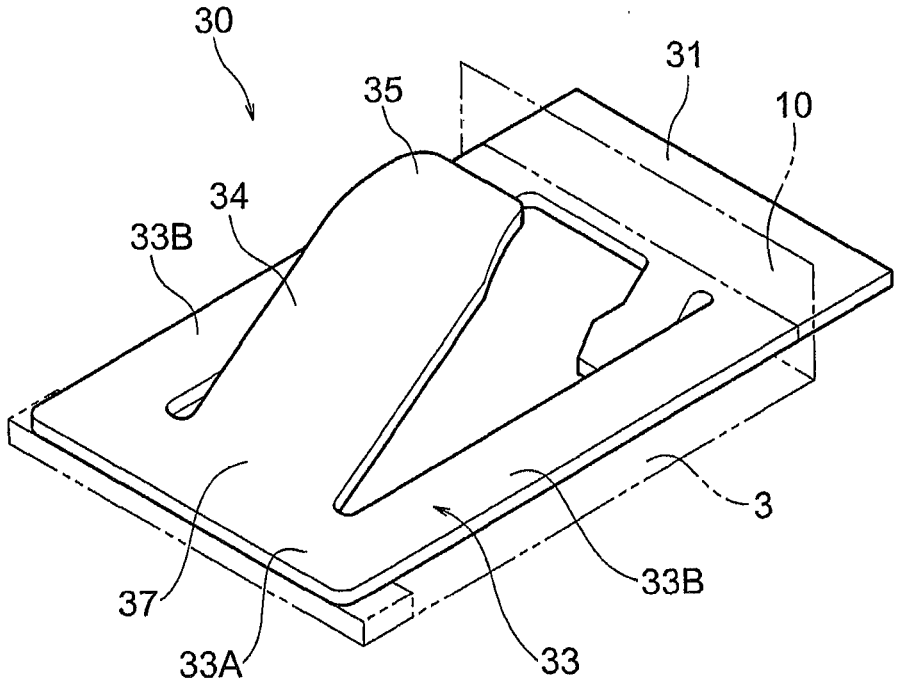
FIG. 12 is a perspective view showing a conventional contact 30.

As shown in FIG. 11, a connector 105 according to the sixth embodiment includes a contact 89 and a connector body 56 as a fixing member that fixes a to-be-fixed portion 4 of the contact 89.

More specifically, the connector body 56 comprises a plate-shape lower wall portion 73 (provided under the contact 89) on which the contact 89 is mounted, and a longitudinal wall portion 71 provided to the lower wall portion 73 so as to cover the to-be-fixed portion 4 of the contact 89.

The connector body 56 is made of, for example, a resin and the to-be-fixed portion 4 is fixed to the longitudinal wall portion 71 by insert molding or press fitting.

On the other hand, the contact 89 comprises a terminal portion 75 extending rearward (direction B in FIG. 11), i.e. rightward in FIG. 11, from the to-be-fixed portion 4 and protruding rightward from the longitudinal wall portion 71.

The connector 105 is configured as follows. The connector body 56 with the contact 89 mounted thereon is moved in a direction E from above a connector board 51 as the other connection object so as to be attached to the connector board 51 and the terminal portion 75 of the contact 89 is connected to a contact point 77 of the connector board 51, so that the contact 89 and the connector board 51 are electrically connected to each other.

As described above, the to-be-fixed portion 4 is not necessarily directly fixed to the connector board 51, but may be fixed to the resin connector body 56 by insert molding or press fitting.

While the preferred embodiments of this invention have been described with reference to the accompanying drawings, this invention is not limited thereto. It is apparent that those skilled in the art can think of various changes and modifications in the category described in the claims and it is understood that those also naturally belong to the technical scope of this invention.

What is claimed is:

1. A contact electrically connecting a plurality of connection objects, comprising:

a to-be-fixed portion adapted to be fixed to a fixing member;

a first spring portion comprising a rearward end portion, in a front-rear direction, joined to the to-be-fixed portion, the first spring portion extending forward from the to-be-fixed portion and elastically deformable relative to the to-be-fixed portion;

a joining portion joined to a forward end portion of the first spring portion;

a second spring portion comprising a forward end portion joined to the joining portion, the second spring portion disposed adjacent to the first spring portion in a width direction perpendicular to the front-rear direction, extending rearward from the joining portion, and elastically deformable relative to the joining portion; and a contact portion provided to the second spring portion and adapted to be in contact with a terminal of one of the connection objects, wherein the second spring portion comprises, between the forward end portion thereof and a rearward end portion thereof, a fulcrum bend portion that is convex in a downward direction perpendicular to the front-rear direction and to the width direction and that is adapted to be constantly in contact with the fixing member, and wherein the fulcrum bend portion is disposed between the forward end portion of the first spring portion and the contact portion in the front-rear direction, and the contact portion is disposed between the fulcrum bend portion and the rearward end portion of the first spring portion in the front-rear direction.

2. The contact according to claim 1, wherein two to-be-fixed portions and two first spring portions are provided in the width direction, and wherein the second spring portion is disposed between the two first spring portions in the width direction.

3. The contact according to claim 1, wherein the first spring portion is provided with a first bend portion, wherein the first spring portion is provided with a second bend portion between the first bend portion and the rearward end portion, and wherein the first spring portion comprises, between the first bend portion and the second bend portion, a portion which is convex in an upward direction perpendicular to the front-rear direction and to the width direction.

4. The contact according to claim 3, wherein the first spring portion comprises a third bend portion provided between the contact portion and the second bend portion in the front-rear direction.

5. The contact according to claim 2, wherein the two to-be-fixed portions are joined together.

6. The contact according to claim 4, wherein the first spring portion comprises a fourth bend portion provided between the first bend portion and the third bend portion.

7. The contact according to claim 1, wherein the contact is formed from a single plate-shape member.

8. The contact according to claim 1, wherein the fixing member is the other of the connection objects, and wherein the to-be-fixed portion is adapted to be fixed to the other of the connection objects by soldering.

9. The contact according to claim 8, wherein the other of the connection objects is a board.

10. The contact according to claim 1, wherein the fixing member is a connector body which forms a connector adapted to be attached to the other of the connection objects.

11. A connector comprising a connector body and the contact according to claim 1 fixed to the connector body.

* * * * *